US006789827B2

(12) United States Patent
Webster et al.

(10) Patent No.: US 6,789,827 B2
(45) Date of Patent: Sep. 14, 2004

(54) MULTIFUNCTION DRUM LIFTER AND WRENCH

(75) Inventors: Thomas Webster, Angola, IN (US); Andy Link, Hamilton, IN (US); Ralph Trine, Angola, IN (US); Kenneth Schneider, Auburn, IN (US); Matthew Clemens, Angola, IN (US)

(73) Assignee: Vestil Manufacturing Company, Angola, IN (US)

( * ) Notice: Subject to any disclaimer, the term of this patent is extended or adjusted under 35 U.S.C. 154(b) by 0 days.

(21) Appl. No.: 10/100,998

(22) Filed: Mar. 19, 2002

(65) Prior Publication Data

US 2003/0178863 A1 Sep. 25, 2003

(51) Int. Cl.[7] ..... B66C 1/00

(52) U.S. Cl. ..... 294/81.5; 294/2; 294/81; 294/90; 294/91

(58) Field of Search ..... 294/2, 8, 67.3, 294/81.1, 81.5, 90, 91; 7/138

(56) References Cited

U.S. PATENT DOCUMENTS

| | | | | |
|---|---|---|---|---|
| 1,704,109 A | * | 3/1929 | Speck et al. | 294/68.3 |
| 2,421,665 A | | 6/1947 | Umbdenstock | |
| 2,576,193 A | | 11/1951 | Reynolds | |
| 2,643,566 A | | 6/1953 | Dos Santos et al. | |
| 2,696,317 A | | 12/1954 | Toffolon | |
| 2,831,720 A | | 4/1958 | Renfroe | |
| 3,352,591 A | | 11/1967 | Casey | |
| 3,488,079 A | | 1/1970 | Stinchfield | |
| 3,733,938 A | | 5/1973 | Smith | |
| 3,915,488 A | | 10/1975 | Anderson | |
| 4,009,898 A | | 3/1977 | Hampton | |
| 4,073,175 A | | 2/1978 | Seamon | |
| 4,359,241 A | | 11/1982 | Kistner | |
| 4,826,228 A | * | 5/1989 | Dinitz et al. | 294/81.56 |
| 4,832,391 A | | 5/1989 | Moell | |
| 4,911,605 A | | 3/1990 | Berg | |
| 5,134,905 A | | 8/1992 | Brennan et al. | |
| 5,171,053 A | | 12/1992 | Rouleau | |
| 5,224,746 A | | 7/1993 | Mullins | |
| 5,303,968 A | | 4/1994 | Trine | |
| 5,374,027 A | * | 12/1994 | Tsai | 294/90 |
| 5,425,289 A | | 6/1995 | Iwinski | |
| 5,501,497 A | | 3/1996 | Holloway | |
| 5,618,154 A | | 4/1997 | Irons, Jr. et al. | |
| 6,048,009 A | | 4/2000 | Sorg | |

OTHER PUBLICATIONS

Publication, Forklift Drum Lifters, McMaster–Carr, pp. 1127–1129, Undated.

Publication, Drum Lifters–Need a Lift?, Basco, pp. 35–39, Undated.

* cited by examiner

*Primary Examiner*—Eileen D. Lillis
*Assistant Examiner*—Michael Lowe
(74) *Attorney, Agent, or Firm*—Baker & Daniels

(57) ABSTRACT

A multifunction drum lifter includes a saddle and a plurality of lift arms pivotally connected to the saddle. Each arm includes a working end having at least one lift finger for engaging the chime of a drum to lift the drum. Preferably the lift arms are three in number and each includes a second lift finger for lifting different sized drums. Each lift arm also includes a plug wrench head and an open end wrench head at its working end so that the lift arms can be used as drum wrenches when removed from the saddle. Preferably each arm has a different plug wrench head and open end wrench head from the other lift arms providing an assortment of drum working tools for the user.

21 Claims, 10 Drawing Sheets

MULTIFUNCTION DRUM LIFTER AND WRENCH

FIELD OF THE INVENTION

This invention relates to drum lifting mechanisms, and particularly to a multifunction drum lifter and drum wrench apparatus. The apparatus is particularly suited for 55-gallon and 30-gallon steel, fiber or plastic drums.

BACKGROUND OF THE INVENTION

Storage drums or barrels are commonly used for storing and transporting various commodities in both liquid and dry form. Such drums are typically cylindrical in shape and made of steel, fiber, or plastic. These drums normally also have a lip around the circumference at each end extending radially beyond the barrel outer surface. This lip is commonly referred to as a "chime."

Fifty-five- and 30-gallon capacities are most frequently used and when filled, these drums can be difficult for one person to move. Various devices have been developed to assist in grasping, lifting and moving or transporting drums. The devices range from tongs that grip the top or sides of the drums to clamps and cradles. Plastic drums, which are more fragile than their steel counterparts, have flexible side walls making it preferable that they be handled from the top, lest the side wall be damaged or punctured and the contents lost or damaged. Drums are routinely stored in an upright position; and, it is often advantageous to maintain this upright position during transport, particularly if the barrel is open at the top and spillage of the contents must be avoided.

One vertical drum lifting device is the subject of U.S. Pat. No. 5,303,968 which is owned by the assignee of the present application. The device of this patent includes a pair of lifting arms that grip the drum under the chime. A locking arm locks the gripping arms in position preventing movement of the gripping surfaces away from the drum.

U.S. Pat. No. 4,359,241 to Kistner, U.S. Pat. No. 3,915,488 to Anderson and U.S. Pat. No. 2,576,193 to Reynolds are three examples of three arm lifting devices that engage the drum under the chime.

Because the chime of the drum is relatively small, it is critical that the chime be positively engaged to prevent inadvertent release by the lifting apparatus. As can be appreciated, this could result in loss or damage to the drum contents or more significantly, could present a safety hazard, especially if the barrel is filled with a heavy or dangerous liquid or material.

Accordingly, a need exists for a drum lifting apparatus that is suitable for use with drums of steel as well as plastic or fiber material. There is a further need for an apparatus that is generally easy to use and that securely engages the drum chime to prevent the inadvertent release of the drum. A further need exists for a drum lifting apparatus that incorporates tools usable in manipulating the various plugs, caps, faucets and ring bolts commonly applied to the drum lid.

SUMMARY OF THE INVENTION

The present invention provides a drum lifter that includes a lifting saddle and a plurality of arm members. The lifting saddle has a base portion and a pair of upright elements defining a bore for a lift pin. Each arm member has a pivot pin at one end for connection to the lift saddle and an opposite working end that has at least one lift finger for engaging a drum chime. Preferably, the arm members are three in number and each arm has a pair of lift fingers for lifting different sized drums.

Further provided is a drum lifting apparatus having arm members that can be used as wrenches. In addition to the lift fingers, the arm members also have various wrench heads built into the working ends. The arm members, or wrenches, can be removed from the lifting saddle and used for manipulating the various plugs, caps, faucets and fittings, and ring bolts used on the drums. When the apparatus includes three wrenches for the arm members, each wrench has a plug head and an open end wrench head that is a different size from the other wrench heads giving the user an assortment of tools for the drums.

Accordingly, this invention provides an apparatus that securely grips the drums and that is distinctive by its simplicity of construction, combined with conveniently built in multifunction drum working tools.

DESCRIPTION OF THE PREFERRED EMBODIMENTS

Figure 1:
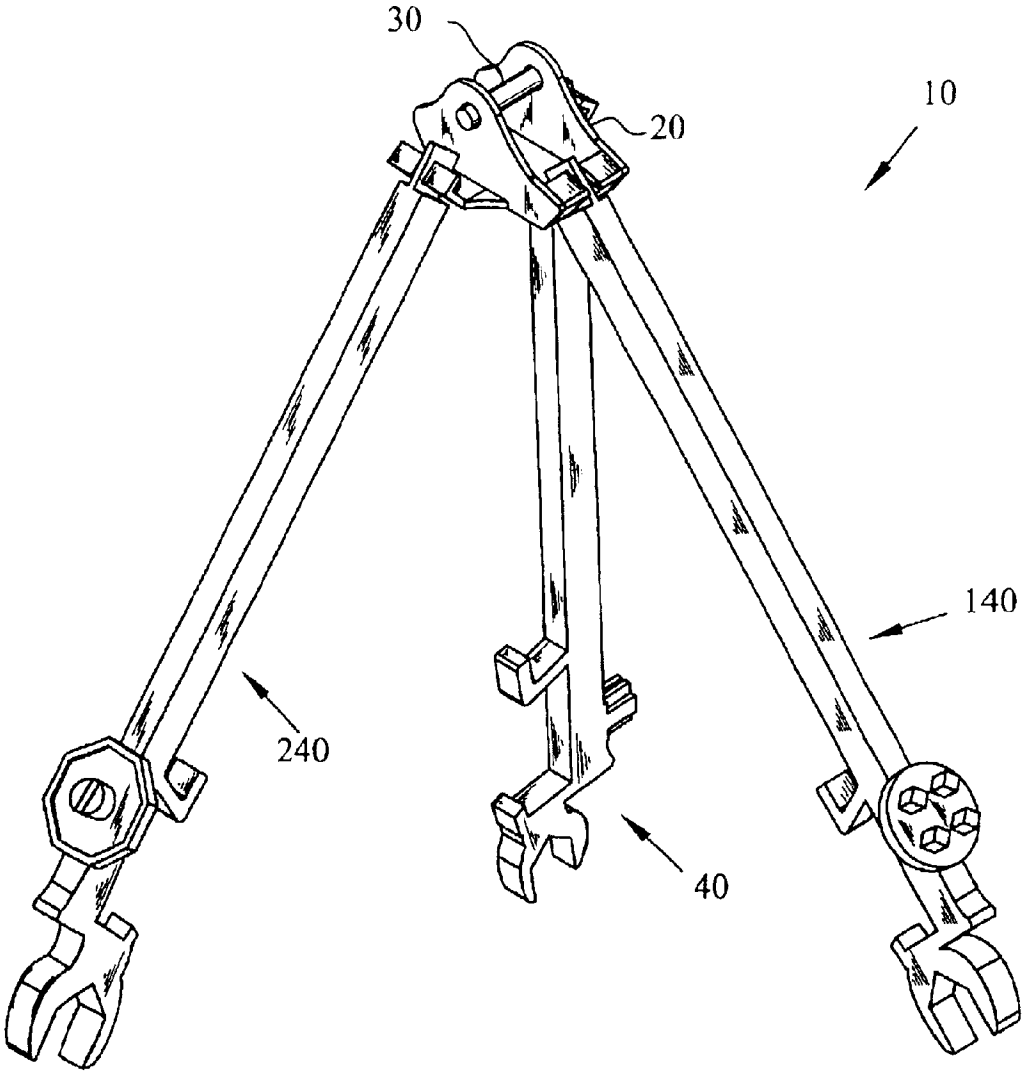
FIG. 1 is a perspective view of one embodiment of a drum lifter according to the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

Referring to FIG. 1, there is shown one embodiment of a drum lifter apparatus according to the present invention generally indicated at 10. The apparatus generally includes a saddle 20, a lifting pin 30, and arm members or lift arms 40, 140, and 240 depending from the saddle 20.

Figure 2:
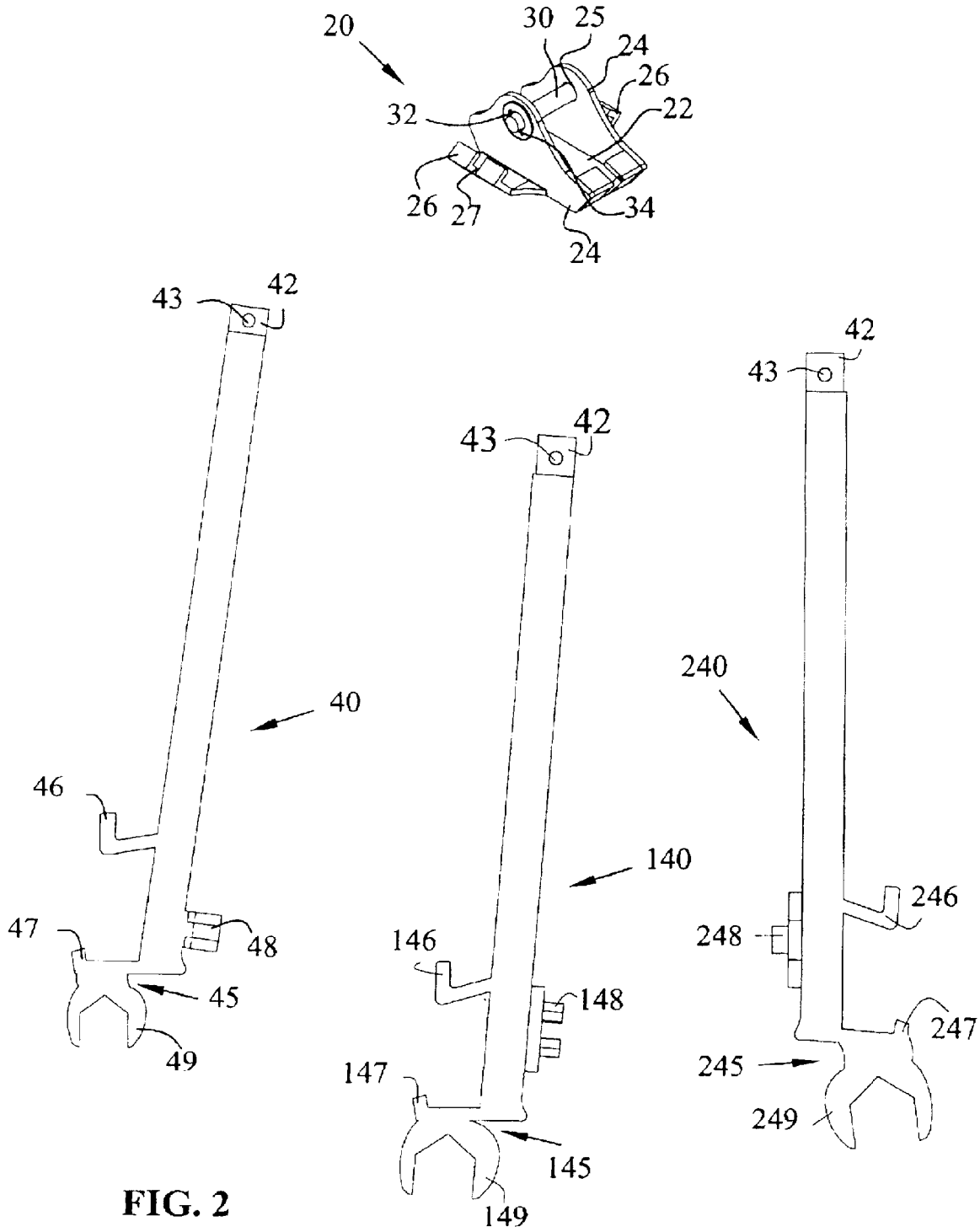
FIG. 2 is an exploded view of the drum lifter of FIG. 1.

Turning to FIG. 2, the saddle 20 is shown having a base portion 22 and a pair of upstanding side elements 24. The saddle also includes a pivot receptacle 26 for each of the lift arms 40, 140, and 240. Each side element 24 includes a hole 25 sized to receive the lift pin 30. Lift pin 30 is retained in the saddle 20 by any of various means known in the art. In one embodiment, the lift pin 30 includes a bore 32 at one end for receiving a cotter pin 34. Alternatively, the lift pin 30 could have a snap ring groove and snap ring for retention in the saddle 20. In yet another embodiment, the lift pin could be a bolt threaded to receive a nut at one end.

With reference still to FIG. 2, lift arm 40 will be described in detail. Lift arm 40 has a pivot end 42 and a working end 45. Pivot end 42 is narrowed to fit within slot 27 in pivot receptacle 26 on the lift saddle 20. Pivot end 42 includes a pivot pin 43 that engages the pivot receptacle 26, transverse to the lift arm slot 27 so that lift arm 40 can pivot relative to the lift saddle 20 while also being retained by the pivot pin 43. The pivot ends of lift arms 140 and 240 are identical to that of lift arm 40 and will not be separately described.

Figure 3:
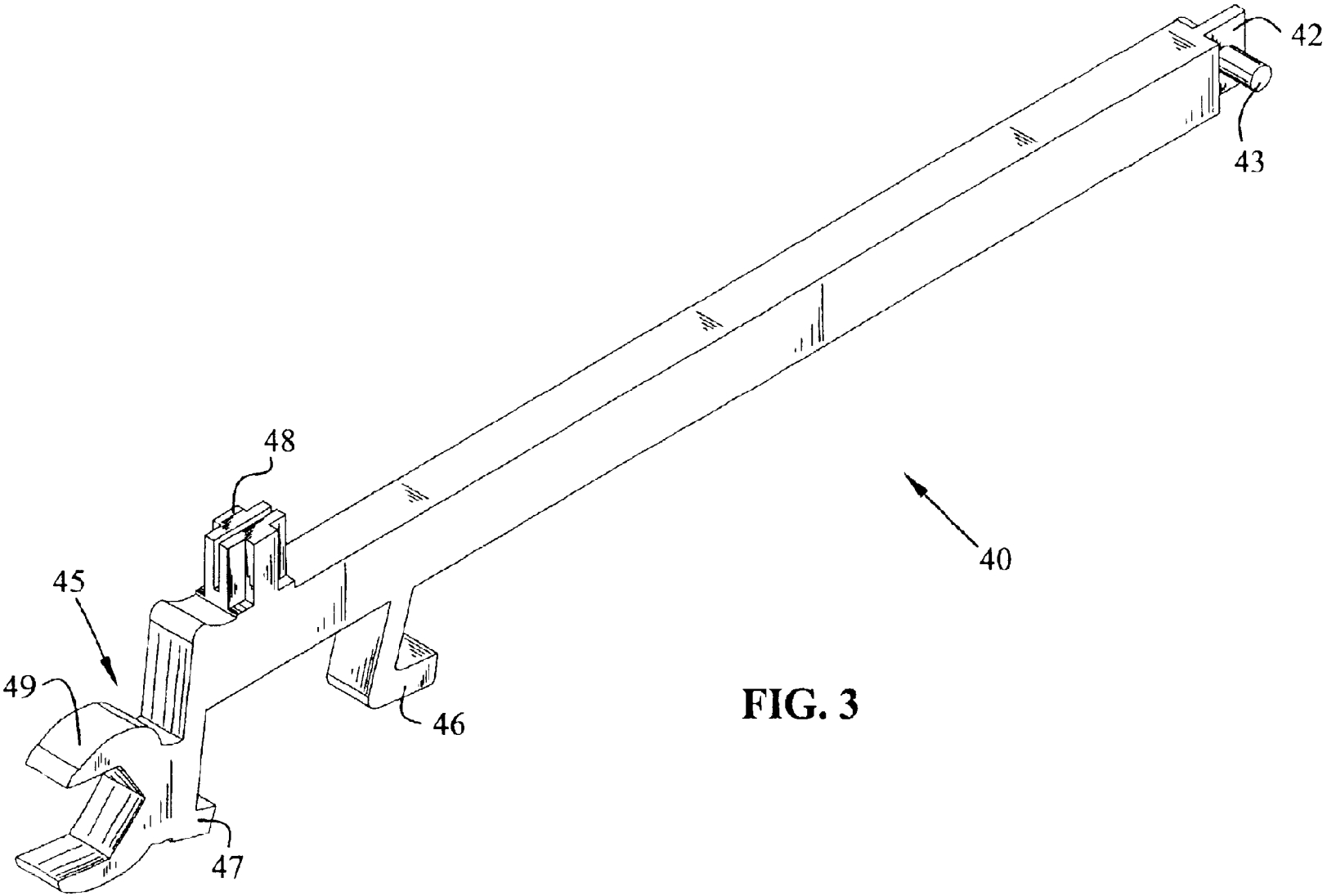
FIGS. 3–5 are close-up perspective views of the working ends of the arm members of FIG. 2.

The working end of lift arm 40 is shown in detail in FIG. 3. As shown in FIG. 3, the working end of lift arm 40 includes a pair of lift fingers 46 and 47 which engage the chime of a drum to lift the drum. Lift fingers 46 and 47 are located at different distances from the pivot end 42 of lift arm 40 to accommodate drums of different diameters. For instance, the inner lift finger 46 being closest to pivot 43 can be used for lifting 30-gallon and similarly sized drums. The outer lift finger, being further from pivot 43, can be used for lifting larger 55-gallon and similarly sized drums.

Also shown in FIG. 3 is a plug wrench head 48 for manipulating one of several types of plugs commonly used in drums. The working end 45 of lift arm 40 also includes an open end wrench head 49. Lift fingers 46 and 47, plug wrench head 48 and open end wrench head 49 are preferably fixedly attached to the lift arm such as by welding. Alternatively, these elements can be integrally formed with the lift arm 40.

Figure 4:
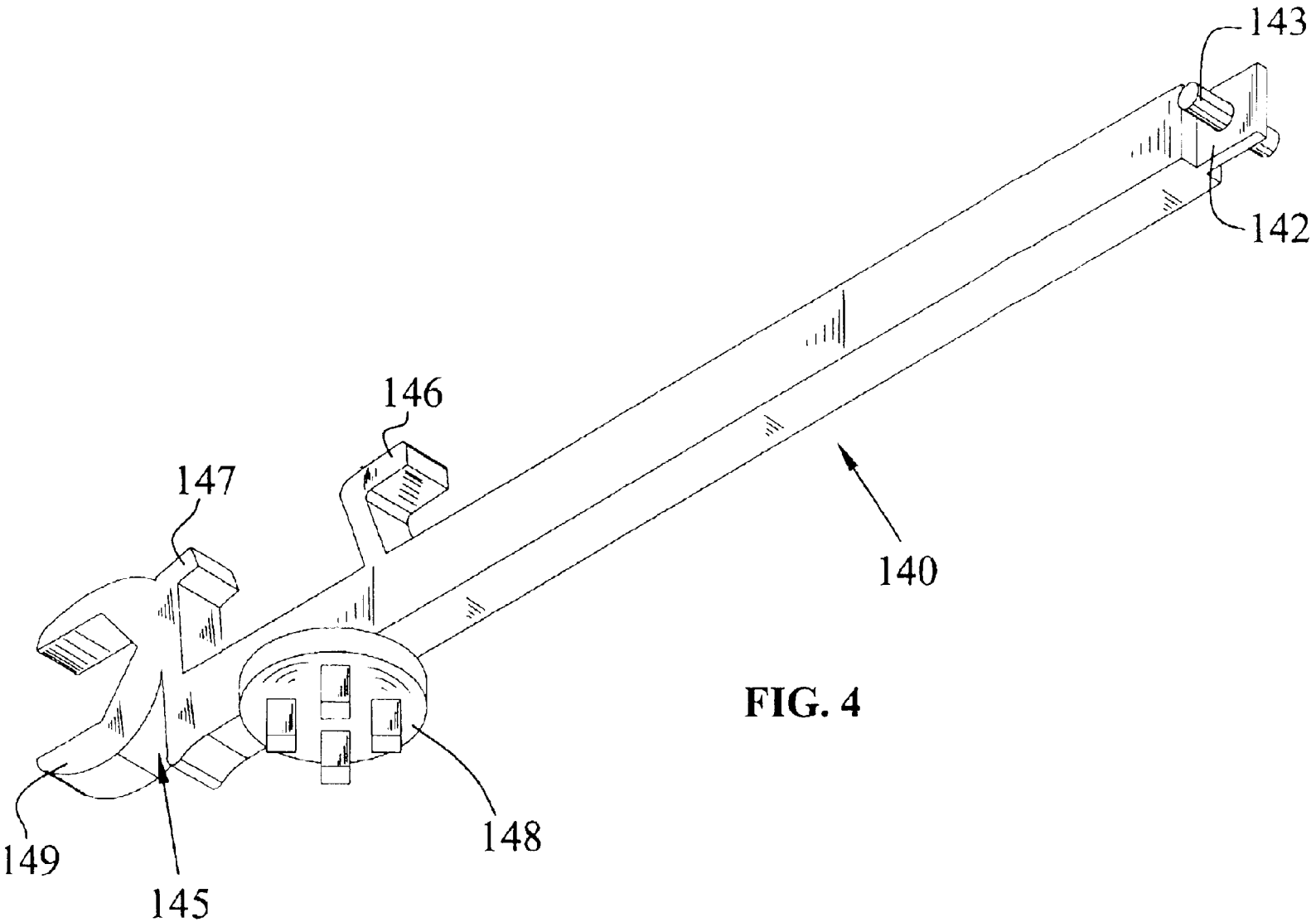

The working end 145 of lift arm 140 is shown in detail in FIG. 4. Lift fingers 146 and 147 are identical to lift fingers 46 and 47 previously described. The working end 145 also includes the plug wrench head 148 which is different from plug wrench head 48 and an open end wrench head 149 which is different from open end wrench head 49.

Figure 5:
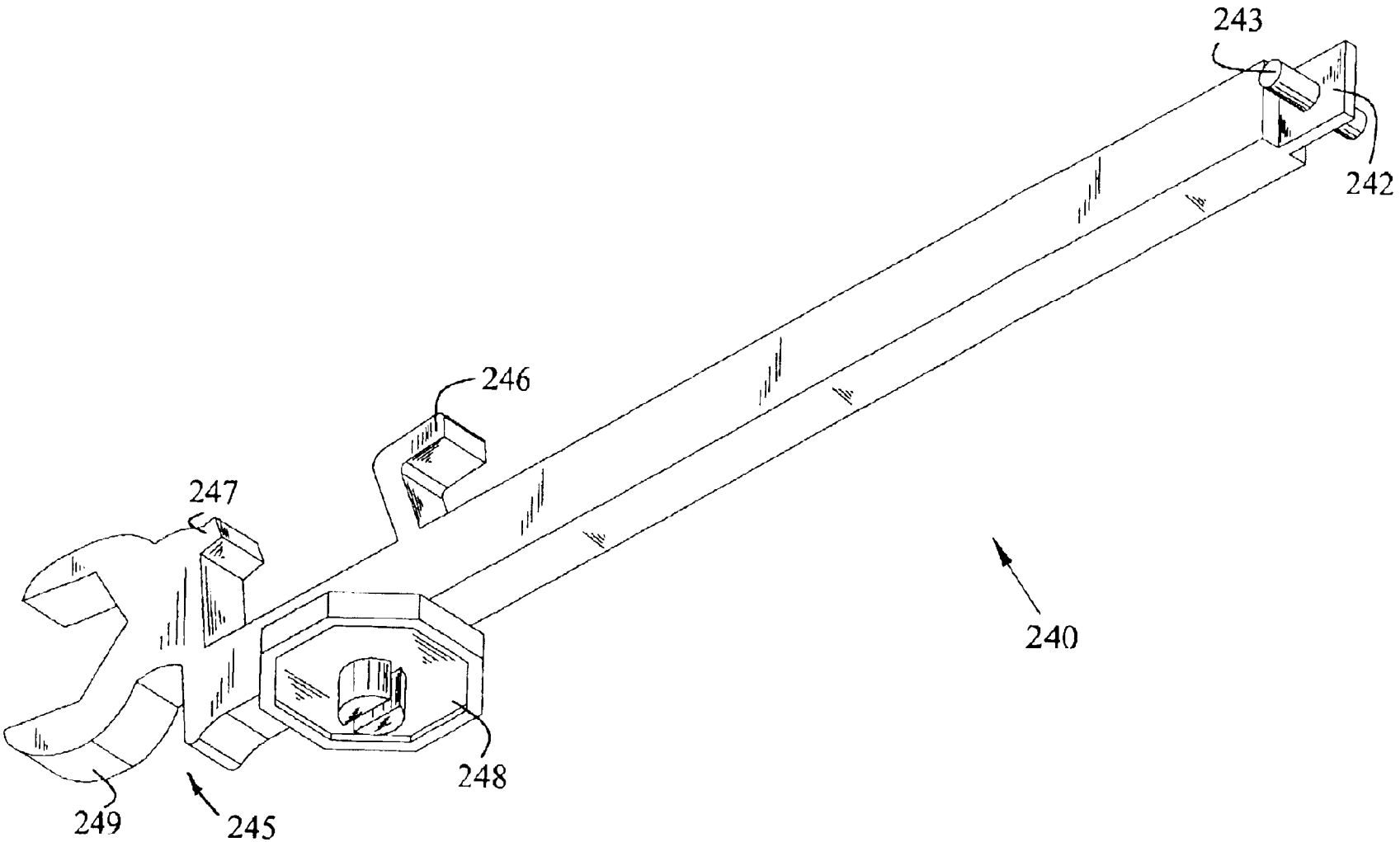

Similarly, the working end 245 of lift arm 240 is shown in FIG. 5. Here again, there are a pair of lift fingers 246 and 247 which are identical to those previously described. Working end 245 also includes plug wrench head 248 which is different from both wrench heads 48 and 148 and an open end wrench head 249 which differs from open end wrench heads 49 and 149.

With plug wrench heads 48, 148 and 248 being different from each other and open end wrench heads 49, 149 and 249 being sized differently from each other, the drum lifting apparatus 10 includes a set of wrenches that taken together provide an assortment of drum working tools enabling the user to manipulate various sizes and types of drum plugs, large and small faucets, as well as drum top ring bolts. Furthermore, as each of the lift arms 40, 140, 240 are removable from the saddle 20, when not in the lifting mode, the lift arms can be easily removed to use as a wrench.

Figure 6:
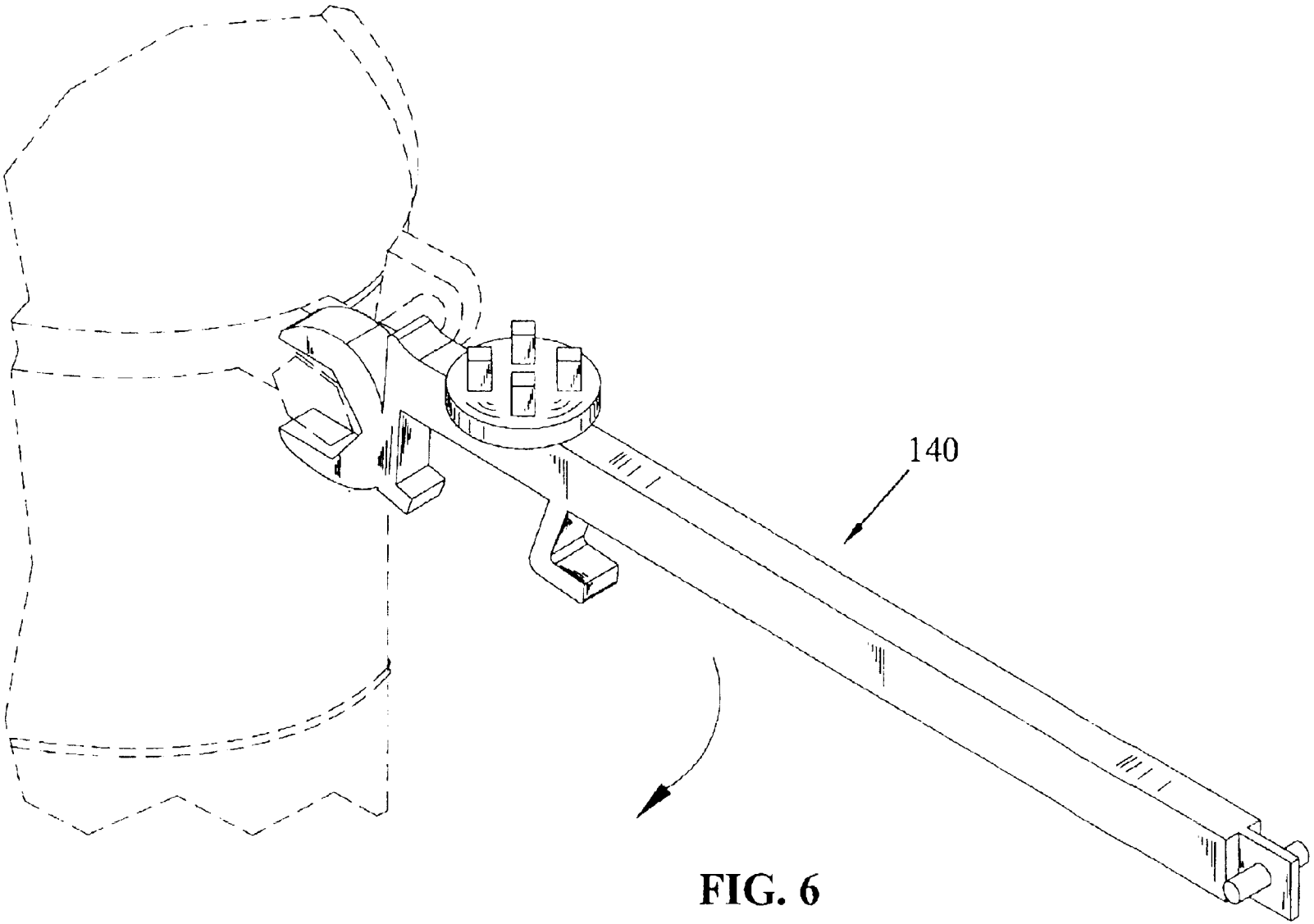
FIG. 6 is a view showing the wrench of FIG. 4 being used to turn a drum ring bolt.
Figure 7:
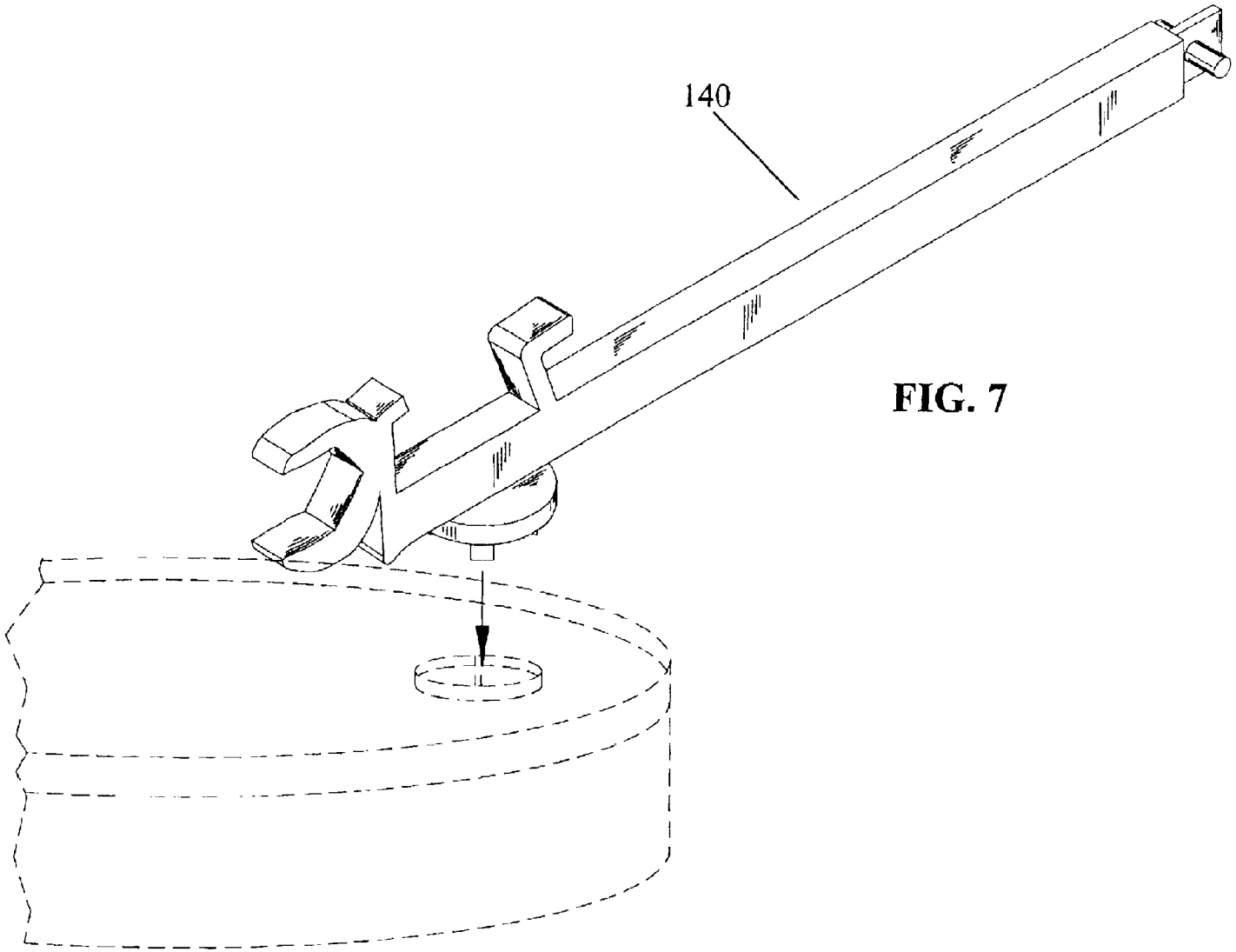
FIG. 7 is a view showing the wrench of FIG. 4 being used to remove a standard drum plug.
Figure 8:
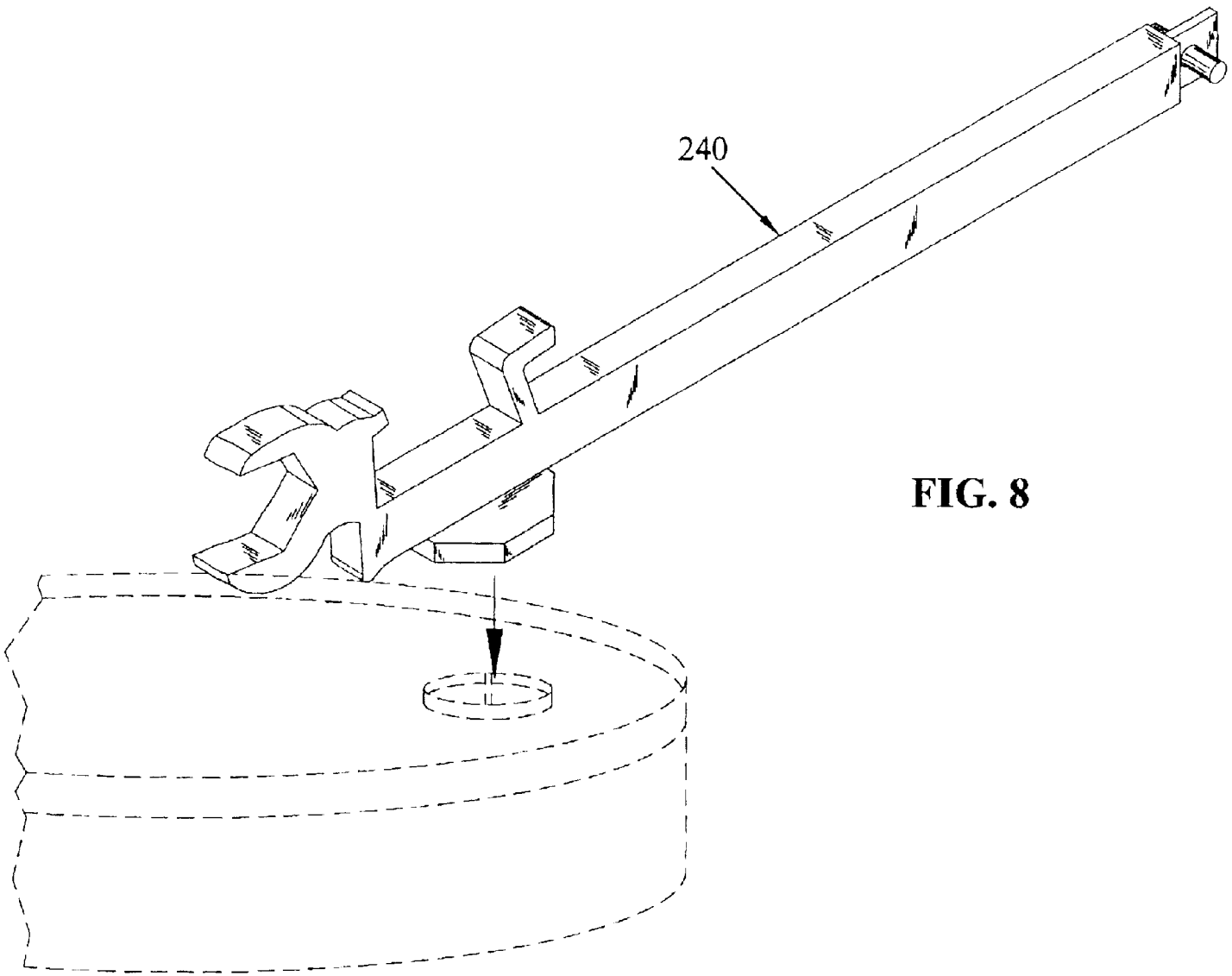
FIG. 8 is a view of the wrench of FIG. 5 being used to remove another typical drum plug.

In FIGS. 6–8 there are shown typical examples of the wrenching applications for which the lift arms can be used. It should be noted that the examples provided are not exhaustive. In FIG. 6, the wrench of lift arm 140 is shown being used to turn a top ring bolt. In FIG. 7, the wrench of lift arm 140 is shown being used to remove a standard drum plug. In FIG. 8, the wrench of lift arm 240 is shown being used to remove another typical drum plug.

Figure 9:
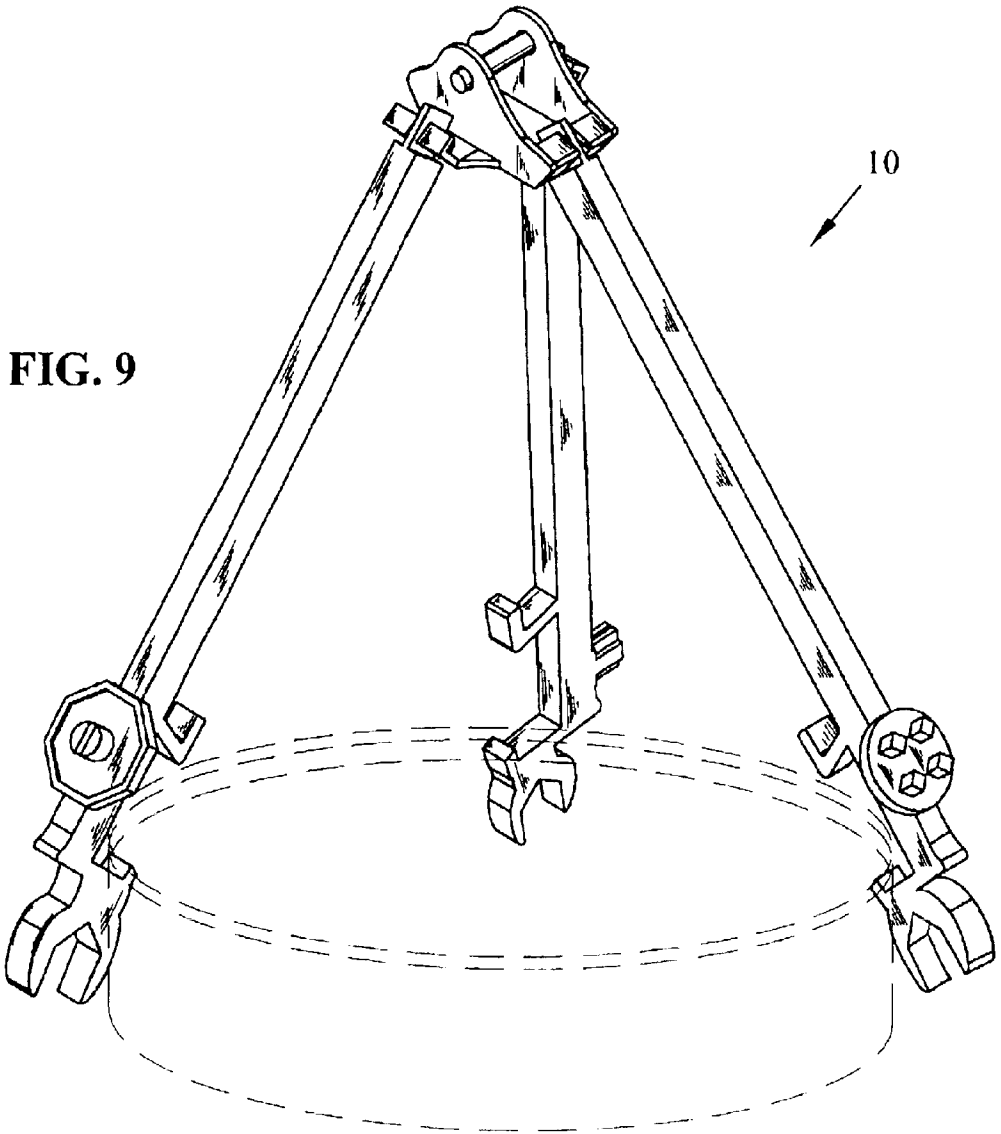
FIG. 9 is a view of a drum lifter according to the present invention, being used to lift a 55-gallon drum.
Figure 10:
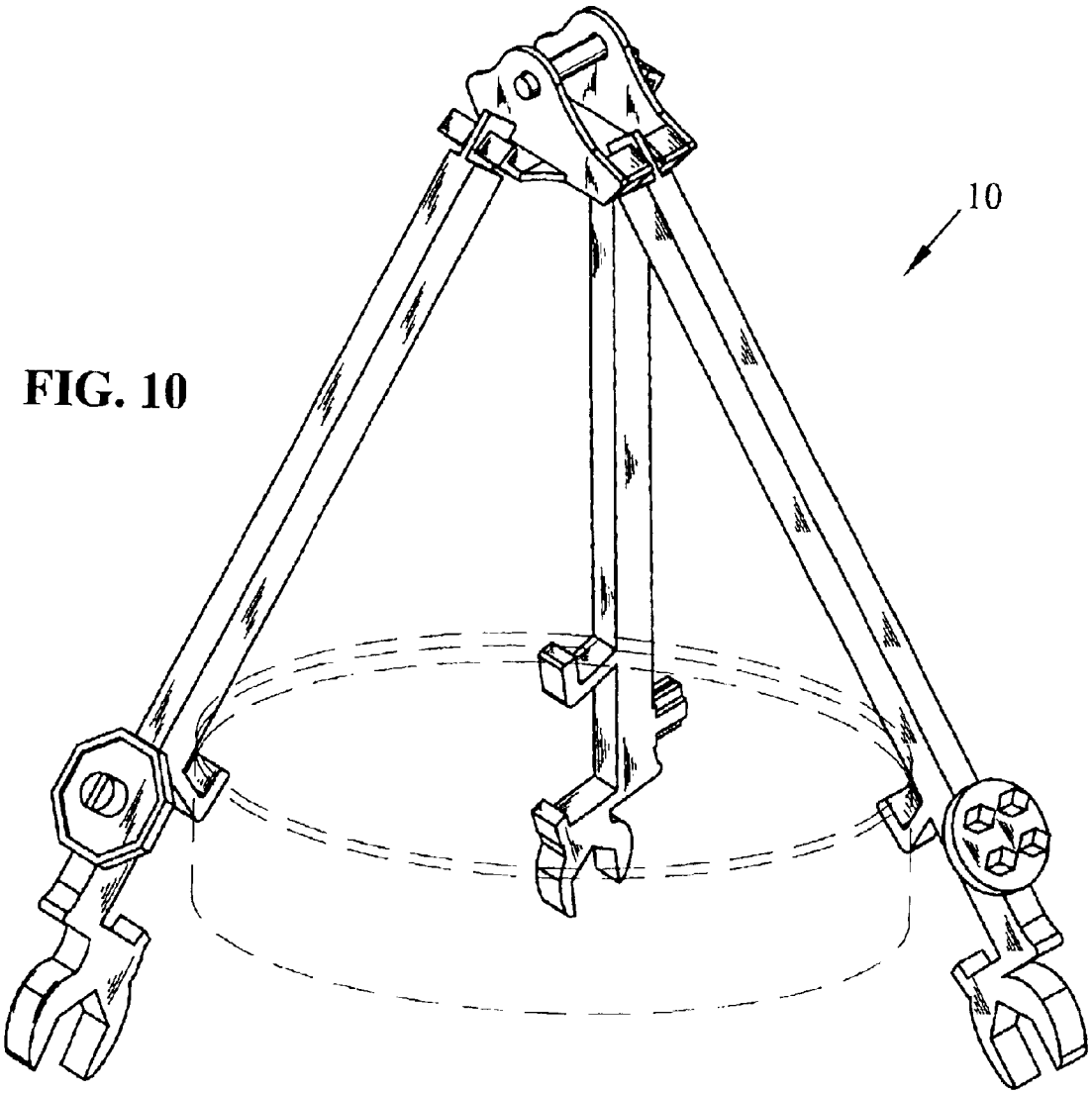
FIG. 10 is a view of a drum lifter according to the present invention, being used to lift a 30-gallon drum.

For lifting drums, the pivot ends of lift arms 40, 140 and 240 are each inserted into a pivot receptacle 26 of the lift saddle 20. The apparatus is then placed on the top of a drum to be lifted with the appropriate lift fingers engaging the chime of the drum. The drum is then securely lifted as depicted in FIGS. 9–10. In FIG. 9, a 55-gallon drum is lifted using the outermost set of lift fingers 47, 147, 247, whereas in FIG. 10, a 30-gallon drum is lifted using the inner lift fingers 46, 146, 246. It should be obvious to those skilled in the art that lift pin 30 can be used to lift the entire assembly 10 together with a drum, by way of a lift hook, such as an overhead crane, or the like.

The drum lifting apparatus 10 overcomes the shortcomings of the prior art by providing a simple yet versatile device for lifting drums combined with a built-in set of drum working tools.

While the invention has been illustrated and described in detail in the drawings and foregoing description, the same is to be considered illustrative and not restrictive in character. It should be understood that only the preferred embodiments have been shown and described, and that all changes and modifications that come within the spirit of the invention are desired to be protected.

What is claimed is:

1. A lifting apparatus comprising:

a lift saddle having a lifting member and a plurality of lift arm attachment elements; and a plurality of lift arms, each said lift arm including a pivot end removably connectable to said saddle for pivotable movement therewith, and a working end opposite said pivot end, said working end including at least one lift finger for engaging the chime of a first drum, and at least one wrench.

2. The lifting apparatus of claim 1, wherein said lift saddle further includes a plurality of pivot receptacles configured to removably receive said pivot end of a respective one of said plurality of wrenches.

3. The lifting apparatus of claim 1, wherein each of said plurality of arm members includes a second lift finger for engaging the chime of a second drum, different in size from said first drum.

4. The lifting apparatus of claim 1, wherein the wrench is an open end wrench.

5. The lifting apparatus of claim 1, wherein the wrench is a plug wrench.

6. A lifting apparatus comprising a saddle portion and a plurality of lift arms attached to said saddle, the saddle having a lifting member for grasping said saddle, said lift arms each having a plurality of lifting hooks, a first hook adjacent a free end of said lift arm, and a second hook longitudinally spaced from said first hook, whereby said first and second plurality of hooks are profiled to lift different drum sizes and said lift arms are removably attached to said saddle portion, and at least one of said lift arms have a wrench portion integrated with said lift arm.

7. The lifting apparatus of claim 6, wherein said wrench is an open end wrench.

8. The lifting apparatus of claim 6, wherein said wrench is a plug removal wrench.

9. A lifting apparatus for a drum having a chime at one end, said apparatus comprising:

a plurality of elongated arm members, each said arm member having a pivot end removably connectable to said lift arm attachment elements of said saddle for pivotable movement therewith, and a working end opposite said pivot end, said working end including at least one lift finger for engaging the chime of a first drum, and at least one of said arm members includes a tool for use in handling of the drum; and a lift saddle having a lifting member and a plurality of lift arm attachment elements, said lift arm attachment elements including a plurality of pivot receptacles configured to removably receive said pivot end of a respective one of said plurality of arm members, without the use of any fasteners, and wherein each said pivot receptacle opens from a top side thereof, and each arm member includes a pivot pin at said pivot end for receipt within a respective one of said pivot receptacles.

10. The lifting apparatus of claim 9, wherein each receptacle is slotted and open from a top side thereof to receive said pivot pin and said arm are receivable in said slot, to nest said pivot in said receptacle.

11. The lifting apparatus of claim 9, wherein each of said plurality of arm members includes a second lift finger for engaging the chime of a second drum, different in size from said first drum.

12. The lifting apparatus of claim 11, wherein said fingers are located at a different longitudinal position as said first lift fingers.

13. The lifting apparatus of claim 9, wherein said plurality of arm members are three in number.

14. A lifting apparatus for a drum having a chime at one end, said apparatus comprising:

a lift saddle having a lifting member and a plurality of lift arm attachment elements; and a plurality of elongated arm members, each said arm member having a pivot end removably connectable to said lift arm attachment elements of said saddle for pivotable movement therewith, and a working end opposite said pivot end, said working end including at least one lift finger for engaging the chime of a first drum, and at least one of said arm members includes a tool for use in handling of the drum, wherein said tool comprises a wrench for use with the drum.

15. The lifting apparatus of claim 14, wherein each said arm includes a wrench for use with the drum.

16. The lifting apparatus of claim 15, wherein said wrenches are profiled as a plug wrench head.

17. The lifting apparatus of claim 16, wherein each said plug wrench head is different from the other of said plug wrench heads.

18. The lifting apparatus of claim 17, wherein each said arm member further includes an open end wrench head at said working end.

19. The lifting apparatus of claim 18, wherein each said open end wrench head is sized to be different from the other of said open end wrench heads.

20. The lifting apparatus of claim 15, wherein said wrenches are profiled as open end wrench heads.

21. The lifting apparatus of claim 20, wherein each said open end wrench head is different from the other of said open end wrench heads.

* * * * *